US007393205B2

(12) United States Patent
Schwartz

(10) Patent No.: US 7,393,205 B2
(45) Date of Patent: Jul. 1, 2008

(54) DEVICE AND METHOD FOR HEATING UP EXTRUSION DIES PRIOR TO THEIR INSTALLATION IN AN EXTRUDER

(75) Inventor: Rolf-Josef Schwartz, Simmerath (DE)

(73) Assignee: Eva Schwartz, Aachen (DE)

( * ) Notice: Subject to any disclaimer, the term of this patent is extended or adjusted under 35 U.S.C. 154(b) by 140 days.

(21) Appl. No.: 11/267,392

(22) Filed: Nov. 4, 2005

(65) Prior Publication Data

US 2007/0117061 A1 May 24, 2007

(51) Int. Cl.
*F27B 14/00* (2006.01)

(52) U.S. Cl. ..... 432/13; 432/247; 425/12; 425/190; 264/472; 65/183

(58) Field of Classification Search ..... 432/210, 432/211, 248, 145, 152, 13, 15, 27, 247, 432/214, 262; 425/182, 190, 192 S, 10, 12, 425/13, 7, 508, 542; 264/39, 37.3, 37.32, 264/37.26, 472; 72/253.1; 65/183
See application file for complete search history.

(56) References Cited

U.S. PATENT DOCUMENTS

| | | | | |
|---|---|---|---|---|
| 4,580,973 | A | 4/1986 | Mansperger et al. | |
| 4,668,271 | A * | 5/1987 | Goode et al. | 65/137 |
| 4,679,542 | A * | 7/1987 | Smith et al. | 126/21 A |
| 4,881,519 | A * | 11/1989 | Henke | 126/21 A |
| 4,965,435 | A * | 10/1990 | Smith et al. | 219/388 |
| 5,131,841 | A * | 7/1992 | Smith et al. | 432/59 |
| 5,463,886 | A * | 11/1995 | Seitz | 72/12.2 |
| 6,422,861 | B1 * | 7/2002 | Antczak et al. | 432/13 |
| 6,592,364 | B2 * | 7/2003 | Zapata et al. | 432/145 |
| 6,866,033 | B2 * | 3/2005 | Stacy et al. | 126/21 A |
| 6,884,969 | B1 * | 4/2005 | Brach et al. | 219/392 |
| 2002/0059950 | A1 * | 5/2002 | Lee et al. | 135/201 |
| 2006/0008967 | A1 * | 1/2006 | Polk et al. | 438/202 |

FOREIGN PATENT DOCUMENTS

| | | |
|---|---|---|
| DE | 9106439 | 7/1991 |
| DE | 19627300 | 1/1998 |
| EP | 0529198 A2 | 3/1993 |
| EP | 0529198 A3 | 3/1993 |
| EP | 0621345 A1 | 10/1994 |

OTHER PUBLICATIONS

"*Neue Anlage zur Erwärmung von Strangpresswerkzeugen,* " Jan. 1999.

* cited by examiner

*Primary Examiner*—Gregory A Wilson
(74) *Attorney, Agent, or Firm*—Marshall, Gerstein & Borun LLP

(57) ABSTRACT

The invention relates to a device for heating up extrusion dies prior to their installation in an extruder, whereby the dies are heated up to a prescribed temperature and kept at this temperature. The device is characterized in that it comprises a gas-tight and thermally insulated oven housing (50) that has at least one charging and discharging opening (70) with an oven cover (40) and, inside the oven housing, there is an impact nozzle field (20) into which a die (90) can be placed, and in that the device (10) is provided with a heating means (100) that heats up a fluid that flows through the openings (110) of the impact nozzle field (20).

Figure 1:
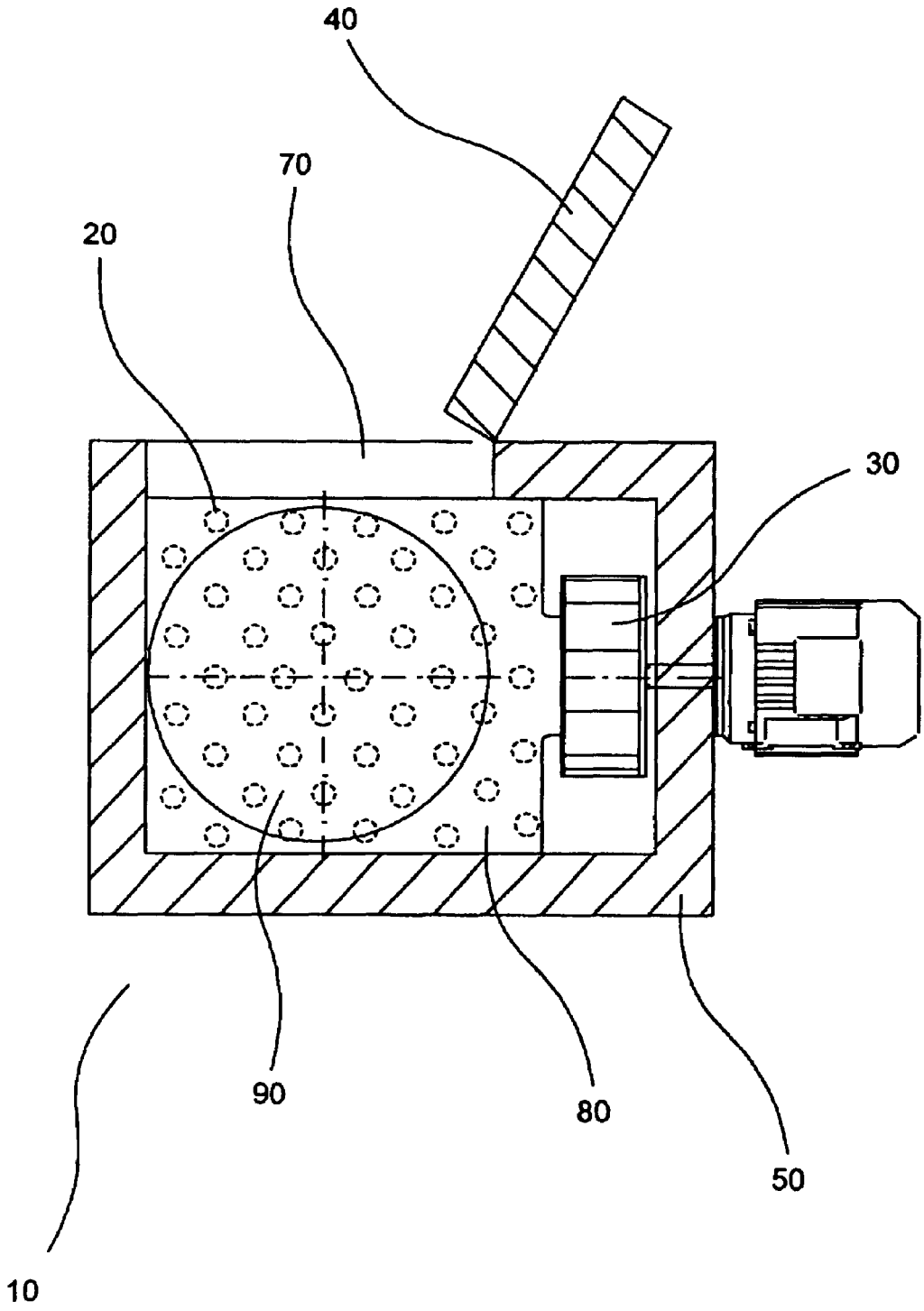

The invention also relates to a method for heating up extrusion dies prior to their installation in an extruder.

16 Claims, 2 Drawing Sheets

DEVICE AND METHOD FOR HEATING UP EXTRUSION DIES PRIOR TO THEIR INSTALLATION IN AN EXTRUDER

The invention relates to a device for heating up extrusion dies prior to their installation in an extruder, whereby the dies are heated up to a prescribed temperature and kept at this temperature.

The invention also relates to a method for heating up extrusion dies prior to their installation in an extruder.

The device and the method are particularly well-suited for heating up dies made of steel that are used to extrude aluminum, nonferrous metals and similar alloys, and for keeping them hot.

When materials are extruded to form profiles, the dies employed for this purpose first have to be heated up to a prescribed temperature. When aluminum is processed into profiles by means of extrusion as is done, for example, for window profiles, the requisite temperature of the dies lies within the range from 400° C. to 550° C. [752° F. to 1022° F.]. The die should be heated up as uniformly and as quickly as possible so as to keep thermal distortion, oxidation and denitridation to a minimum and so that the die can be prepared quickly. These dies are usually round elements with filigree openings that are made of high-strength steel and that consist of several plates connected behind one another.

The dies are normally heated up to a prescribed temperature by means of a radiation or convection oven. Here, chamber or chest ovens are used which hold one or more dies. The ovens are usually heated with electric resistors, by gas flames or with a combination of these heating means.

These conventional heating methods are associated with specific drawbacks. Heating the dies by means of a radiation or convection oven entails relatively long heating times due to the low heat-transfer coefficients that, for physical reasons, can be achieved at this temperature. Moreover, large ovens are necessary which, in turn, call for a great deal of floor space and entail high empty losses since the oven wall losses are proportional to their surface area. Moreover, a large inner surface of the oven is heated up to the heating temperature which, once operation stops, cools down again, without the possibility of recovering this heat.

Moreover, in the above-mentioned ovens, the dies are only heated up slowly since the heat-transfer coefficient is relatively low. In the case of radiation heat, one often encounters the problem of overheating of the filigree elements of the die, since heat radiators have a typical temperature of about 800° C. [1472° F.] and consequently generate undesired temperature gradients in the die. The technique of magnetic-field heating is often used, but this likewise entails the drawback of a difficult temperature distribution. Moreover, magnetic field heating does not allow the use of inert gas or reaction gas and this technique entails high acquisition costs. In multiple die ovens, it often happens that cold dies are placed next to completely heated dies and these then impermissibly cool off at the filigree elements. This can cause the die to break during the extrusion, which likewise results in high costs.

European patent application EP 0 529 198 A2 discloses, for instance, an oven with a controlled atmosphere that is particularly well-suited for heating extrusion molds for aluminum or alloys thereof. The oven has several chambers into each of which a mold to be heated can be placed. The heating is done by means of electric resistors and preferably in an atmosphere that is free of oxygen in order to prevent oxidation of the mold surfaces. Each chamber can be opened like a drawer so that removing one die does not influence the condition in the other chambers.

U.S. Pat. No. 4,580,973 discloses a kiln to fire ceramic wares that has a uniform temperature distribution. A hot gas stream is fed into the kiln and passes through it at a high velocity. In order to prevent the ceramic wares located close to the port orifice from being damaged due to excessive heat, the kiln has a deflector plate behind each port orifice, said deflector plate guiding the gas stream in parallel along the walls of the kiln. As a result, a uniform temperature distribution can be achieved inside the kiln.

The objective of the invention is to provide a device for heating up dies that are used to extrude materials, and for keeping them hot, whereby said device avoids the disadvantages of prior-art ovens. In particular, the device should attain a high heat-transfer coefficient, allow a uniform heating of the dies while taking up only a small amount of space.

It is likewise the objective of the invention to provide a method for heating up dies that are used to extrude materials, whereby the materials are heated up as quickly and uniformly as possible, whereby the method does not require much energy and any detrimental impact on the chemical properties of the die steel is kept to a minimum.

According to the invention, this objective is achieved by means of a device having the features of claim 1 and by a method having the features of claim 8. Advantageous refinements of the invention can be gleaned from the subordinate claims 2 to 7 and 9 to 12.

The device according to the invention for heating up extrusion dies prior to their installation in an extruder, whereby the dies are heated up to a prescribed temperature and kept at this temperature, comprises a gas-tight and thermally insulated oven housing that has at least one charging and discharging opening with an oven cover. Inside the oven housing, there is an impact nozzle field into which a die can be placed. The device is also provided with at least one heating means that heats up a fluid flowing through the openings of the impact nozzle field. The device is preferably operated with inert gas or reaction gas. This gas atmosphere inside the installation is provided as protection against oxidation or other undesired chemical effects. For example, it prevents the degradation of the nitride layer.

In a particularly preferred embodiment of the invention, the device has at least one fan to circulate the fluid through the heating means and through the impact nozzle field. The fans can accelerate the fluid employed, for instance, to nozzle outlet velocities of about 20 to 100 m/s. In a particularly preferred embodiment of the invention, the fluid is fed to the dies by means of nozzles through which the flow direction and flow velocity of the fluid can be configured in such a way that a maximum heat-transfer output is achieved when the fluid impinges the die. In this context, the impact jets preferably impinge the dies perpendicularly or at an angle of 80° to 100° relative to the surface.

Heat can be supplied to the heating means in different ways. It has been found to be advantageous to heat the impact-jet oven directly or indirectly. This can be done, for example, with electric resistance elements or else by means of one or more fuel-operated burners. It has proven to be advantageous to use a thermostat to keep the impact nozzle field at a temperature that lies above the prescribed heating temperature of the dies. Here, the temperature of the fluid is, for example, 10° C. to 100° C. [18° F. to 180° F.] above the prescribed heating temperature of the dies.

The invention also comprises a method for heating up extrusion dies prior to their installation in the extruder, whereby the dies are heated up to a prescribed temperature and kept at this temperature. In this context, the dies are placed into a device that has an impact nozzle field in which the dies are heated up to at least the prescribed temperature. After the die has been heatedup, it is installed in an extruder. The fluid employed is preferably heated up by heating means and then made to flow over one or more dies through nozzle openings by means of one or more fans. In an especially preferred embodiment of the invention, only one die at a time is placed into the device, where said die is heated up and kept at a prescribed temperature.

The invention moves away from single-die or multiple-die ovens that employ convection or radiation heating and instead, it uses a nozzle field with impact jets that has very good prerequisites for the relevant temperature range. The use of an impact jet oven entails various advantages. For instance, the impact-jet heating is not critical in terms of excess temperatures and the attendant excessive temperature gradients. Moreover, heating with impact jets is easy to implement and its handling is well established. Furthermore, this constitutes a cost-efficient heating technique.

The main advantage of an impact jet oven lies in the very good and uniform heat transfer between the nozzle field and the dies, which is achieved by the highly turbulent contact between the die surface and the impact fluid. Heat-transfer coefficients of up to 150 $W/m^2 \cdot h$ can be attained with this type of heating in comparison to approximately 50 $W/m^2 \cdot h$ with normal convection or radiation techniques.

If the device according to the invention is configured as a chest oven into which only one extrusion die is placed at a time, the dimensions can be kept small. Moreover, the heating of the dies is not influenced by cold dies that are close to dies that have already been heated up. The embodiment according to the invention involving a device with an impact nozzle field also makes it possible to largely avoid chemical changes during the occasionally very long holding phases of a die in a heating oven.

Other advantages, special features and advantageous refinements of the invention ensue from the subordinate clams and from the presentation below of a preferred embodiment making reference to the figures.

Figure 2:
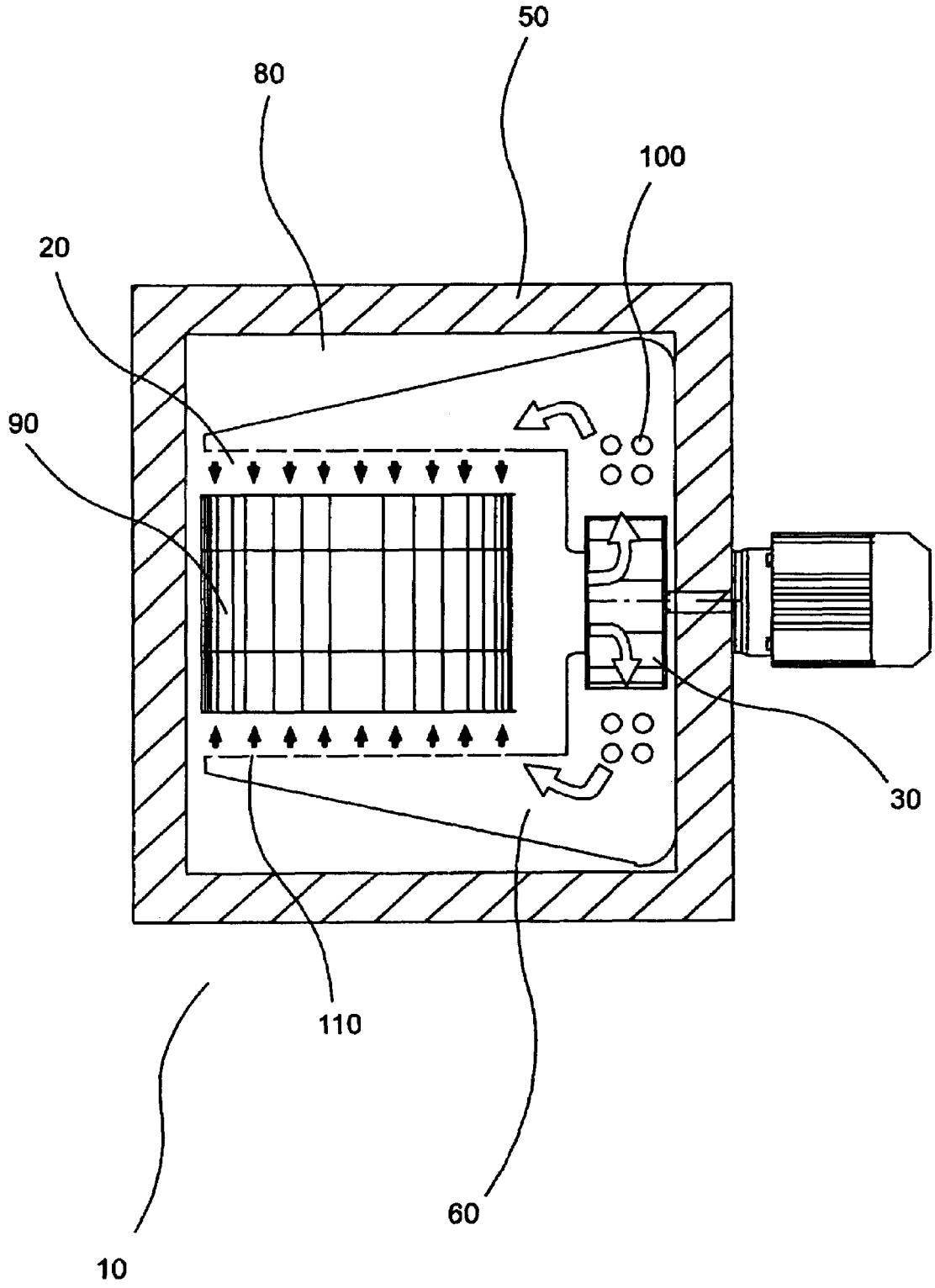

These figures show the following:

FIG. 1-*a* schematic depiction of the device according to the invention in a side view; and FIG. 2-*a* schematic depiction of the device according to the invention in a top view.

The device depicted in FIGS. 1 and 2 is an oven 10 with several structural features. In FIG. 1, the device is shown in a side view, whereas FIG. 2 depicts a top view of the device. The arrows indicate the direction of flow of the fluid inside the device. Here, the white arrows indicate the direction of flow inside the pressure chamber of the device while the black arrows indicate the direction of flow of the liquid in the impact nozzle field.

The dies 90 to be heated up in the device are extruder dies that often consist of several round steel plates with holes and impressions. Such a die is shown by way of example in FIG. 1 as a round plate 90. Materials are extruded through such steel plates in order to create a certain profile. In addition to various plastics, it is also possible to extrude aluminum, nonferrous metals or similar alloys through a die. However, dies of different shapes can also be heated for later installation in an extruder. The system and the heating method are particularly suitable for heating up extruder dies that are made of high-strength steel grades.

The oven 10 comprises a gas-tight and thermally insulated oven housing 50 into which the dies 90 can be placed through one or more charging and discharging openings 70. The dies are subsequently heated up to a prescribed temperature in an impact nozzle field 20. In FIG. 1, the impact nozzle field is indicated by broken lines. The nozzles are preferably arranged on at least two sides of a pressure chamber 60 inside the oven chamber 80.

After a prescribed holding time in the nozzle field 20, the die 90 placed there is heated up to the prescribed temperature which, for some grades of steel, is 400° C. to 550° C. [752° F. to 1022° F.]. At the end of a prescribed time, the oven chamber 80 can be flooded and purged with inert gas or reaction gas. As soon as a die 90 is needed, the operator removes it by opening the oven cover 40 and inserts it directly into the extruder.

The nozzle field 20 consists primarily of a pressure chamber 60 and an oven chamber 80 that is highly insulated towards the outside and that is configured so as to be gas-tight. The nozzle field 20 can be heated up in different ways. For example, the heating can be done electrically or with fuel. The heating temperature of the nozzle field corresponds to at least the prescribed heating temperature of the dies, although it preferably lies somewhat higher than this. The temperature actually needed has to be ascertained empirically. Typical temperature differences lie in the order of magnitude of 10° C. to 100° C. [18° F. to 180° F.]. At a processing temperature of about 650° C. [1202° F.], the nozzle field temperature lies, for instance, 20° C. [36° F.] above the prescribed heating temperature of the dies.

The dies 90 located in the oven chamber 80 are continuously surrounded by fresh fluid that is accelerated by means of one or more fans 100. In this process, the fluid exits from several openings 110 and impinges the die in the form of a typical impact jet. As a result, a very good heat transfer from the fluid to the die is achieved, so that short heating times can be implemented in this manner. In comparison to conventional heating methods, only one-third as much time is needed and the temperature is cut in half.

The invention claimed is:

1. A device for heating up extrusion dies prior to their installation in an extruder, whereby the dies are heated up to a prescribed temperature and kept at this temperature, characterized in that the device comprises a gas-tight and thermally insulated oven housing that has at least one charging and discharging opening which is covered by an oven cover, and in that, inside the oven housing, there is an impact nozzle field into which a die can be placed, and in that the device is provided with a heating means that heats up a fluid flowing through the openings of the impact nozzle field.

2. The device according to claim 1, characterized in that at least one fan is provided to circulate the fluid through the heating means and through the impact nozzle field.

3. The device according to claim 2, characterized in that the at least one fan and impact nozzle field are configured to accelerate the fluid employed to a nozzle outlet velocity in a range of about 20 m/s to about 100 m/s.

4. The device according to claim 1, characterized in that the heating means can be electrically heated.

5. The device according to claim 1, characterized in that the heating means can be heated by a fuel-operated burner.

6. The device according to claim 1, characterized in that a thermostat can be used to keep the impact nozzle field at a temperature that lies above the prescribed heating temperature of the dies.

7. The device according to claim 6, characterized in that the temperature of the fluid is about 10° C. to 100° C. [18° F. to 180° F.] above the prescribed heating temperature of the dies.

8. The device according to claim 1, characterized in that the device is operated with inert gas or reaction gas.

9. The device according to claim 1, characterized in that the heating means is capable of heating the fluid to a temperature about 10° C. to 100° C. [18° F. to 180° F.] above a prescribed heating temperature of the dies in a range of 400° C. to 550° C.

10. A method for heating up extrusion dies prior to their installation in an extruder, whereby the dies are heated up to a prescribed temperature and kept at this temperature, characterized in that the dies are placed into a gas-tight and thermally insulated oven housing of a device through a charging opening and the charging opening is covered by an oven cover and that the device has an impact nozzle field in which the dies are heated up to at least the prescribed temperature.

11. The method according to claim 10, characterized in that only one die at a time is placed into a device, where said die is heated up and kept at the prescribed temperature.

12. The method according to claim 10, characterized in that the method is carried out in the device in an inert-gas or reaction-gas atmosphere.

13. The method according to claim 10, characterized in that a fluid is heated up by heating means and then made to flow over one or more dies through nozzle openings by means of one or more fans.

14. The method according to claim 10, characterized in that, after the dies have been heated up, they are installed in an extruder.

15. The method according to claim 10, characterized in that the prescribed temperature is in a range of 400° C. to 550° C.

16. The method according to claim 10, characterized in that a fluid is accelerated through the impact nozzle field to a nozzle outlet velocity in a range of about 20 m/s to about 100 m/s.

* * * * *